US005150893A

United States Patent [19]

Uno et al.

[11] Patent Number: 5,150,893

[45] Date of Patent: Sep. 29, 1992

[54] PAPER FEED MECHANISM WITH PLURAL SUPPORT TABLES FOR SUPPLYING CUT SHEETS TO A PRINTING APPARATUS

[75] Inventors: Kazuo Uno; Junji Shirakawa, both of Ibaraki, Japan

[73] Assignee: Hitachi Koki Co., Ltd., Tokyo, Japan

[21] Appl. No.: 710,480

[22] Filed: Jun. 5, 1991

[30] Foreign Application Priority Data

Jun. 8, 1990 [JP] Japan ..... 2-151212

[51] Int. Cl.[5] ..... B65H 1/26

[52] U.S. Cl. ..... 271/157; 271/171; 414/795.8

[58] Field of Search ..... 414/795.8; 271/157-159, 171

[56] References Cited

U.S. PATENT DOCUMENTS 3,404,790 10/1968 Brookhyser ..... 414/795.8
3,887,178 6/1975 Fujimoto ..... 414/795.8
4,148,473 4/1979 Johnson ..... 271/157
4,189,136 2/1980 Robinette ..... 271/157
4,457,658 7/1984 Meylan ..... 414/795.8
4,801,135 1/1989 Povio ..... 271/157

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

A paper feed mechanism for a printing apparatus, comprises a case, a plurality of tables provided in the case for supporting at least two kinds of cut sheets thereon, the two kinds of cut sheets including large-sized cut sheets larger than each table and small-sized cut sheets substantially equal to each table, and a unit for moving the small-sized cut sheets on one table to another table when another table becomes empty of the small-sized cut sheets, wherein when the plurality of tables support the large-sized cut sheets, the plurality of tables function as one table, and when the plurality of tables support the small-sized cut sheets, the plurality of tables function separately independently of each other.

5 Claims, 2 Drawing Sheets

PAPER FEED MECHANISM WITH PLURAL SUPPORT TABLES FOR SUPPLYING CUT SHEETS TO A PRINTING APPARATUS

BACKGROUND OF THE INVENTION

This invention relates to a paper feed mechanism for feeding cut sheets, which mechanism is connected to the interior or the exterior of a printing apparatus, such as a copying machine and a printer, or an image forming apparatus.

There are cut sheets of various sizes (for example, A5, A4, A3, B5 and B4). FIG. 1 shows a conventional paper feed mechanism. In FIG. 1, the size of a table 2 on which paper sheets are placed is at least larger than the size of the paper sheet of the maximum size, and paper sheets of various sizes can be suitably set on the table by moving a paper guide 1 in a direction perpendicular to the direction of feed of the paper, that is, by moving the table to a position corresponding to the widthwise dimension of the paper. FIG. 2 is a view as seen from the side of the paper feed mechanism. The height of the uppermost one of the cut sheets stacked on the table 2 is detected by a height sensor 8, and the height is automatically adjusted to a predetermined level by an associated means (connected to the table via pulleys 7 and a line 4) not shown.

When cut sheets of A4-size are loaded into such a conventional paper feed mechanism which can accommodate cut sheets, for example, of up to A3-size, about a half of the paper feed mechanism becomes a useless space. In order that the apparatus can operate efficiently, it is desirable that the number of the cut sheets to be loaded at one time be as large as possible. Therefore, generally, the copying machine or the printer for a higher-speed operation or for mass- printing application is provided with a paper feed mechanism of a larger capacity.

However, accommodating a large number of cut sheets poses a problem in that the size of the apparatus becomes excessively large.

SUMMARY OF THE INVENTION

This invention has been made in order to overcome the above problems, and an object of the invention is to provide a paper feed mechanism which can accommodate more than twice as many cut sheets as those accommodated by the conventional mechanism, with the same size.

In the present invention, in view of the fact that when A4-size cut sheets are accommodated in a space capable of accommodating A3-size cut sheets, about a half of this space is useless, a table for supporting the cut sheets thereon is divided into two portions so that A4-size cut sheets can be additionally accommodated in this spare space, thereby increasing the amount of cut sheets which can be accommodated.

DETAILED DESCRIPTION OF THE PREFERRED EMBODIMENTS

Figure 1:
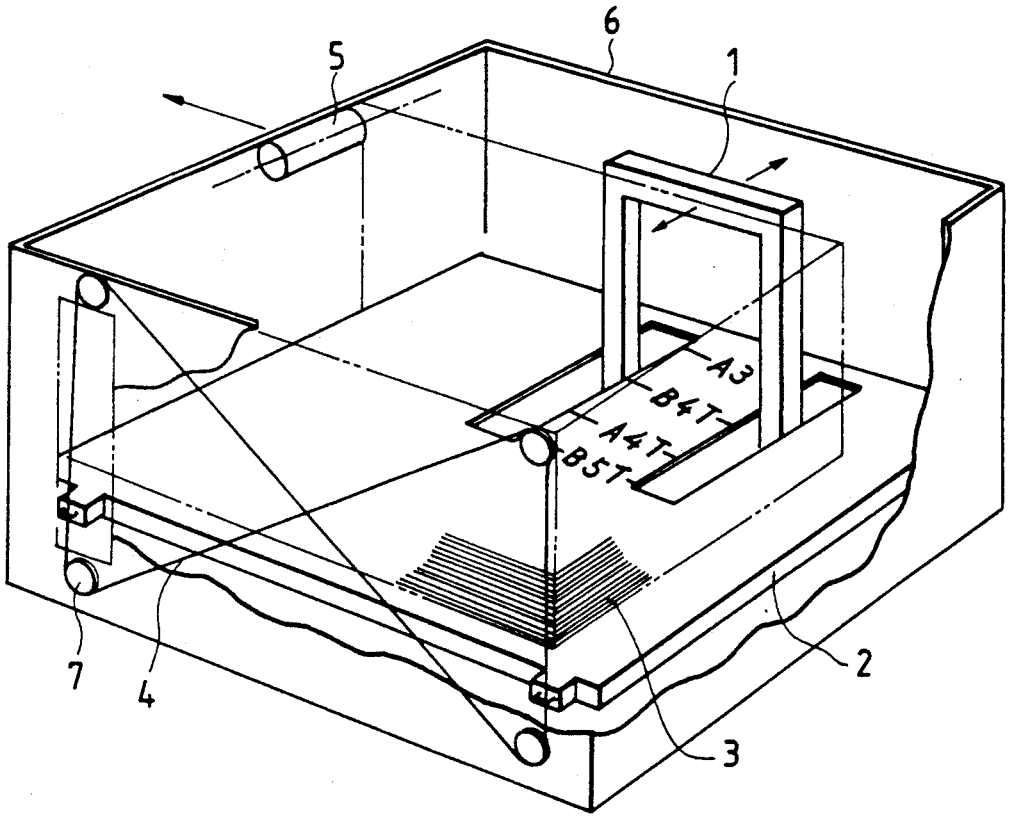
FIG. 1 PRIOR ART
FIG. 1 is a perspective view of a conventional paper feed mechanism.
Figure 2:
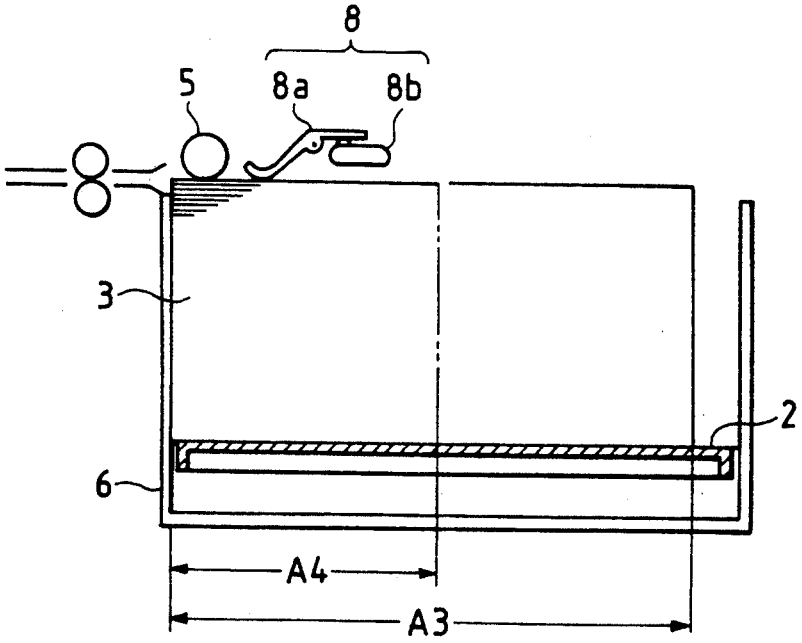
FIG. 2 PRIOR ART
FIG. 2 is a vertical cross-sectional view of the paper feed mechanism of FIG. 1.
Figure 3:
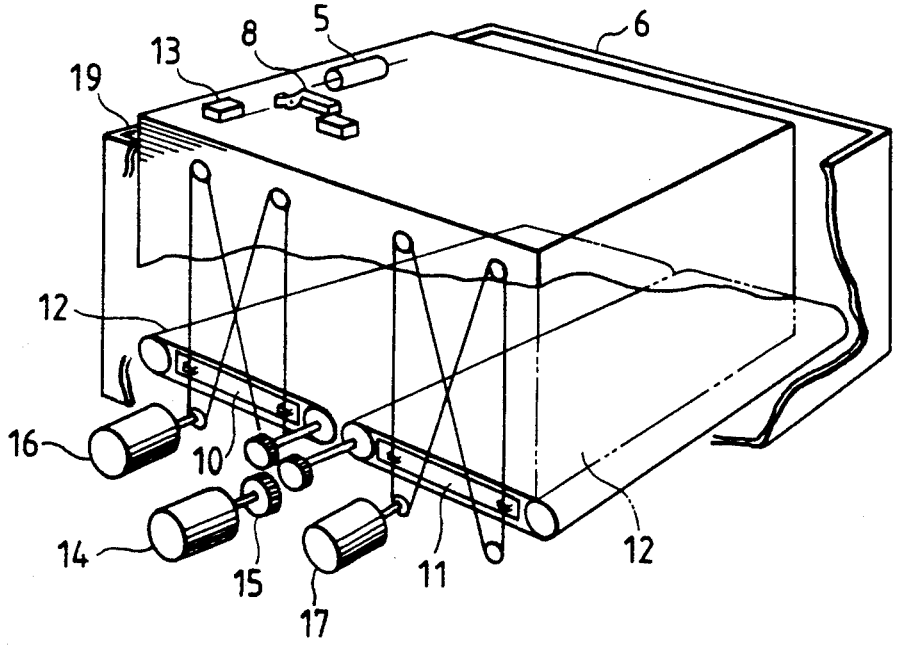
FIGS. 3 and 4 are perspective views of a paper feed mechanism of the present invention, respectively.
Figure 4:
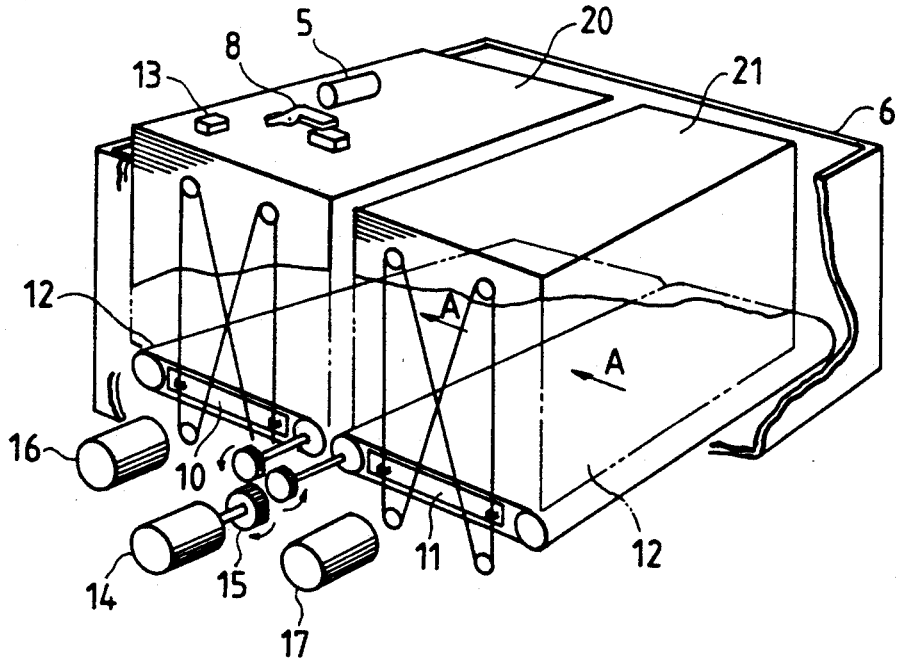

FIGS. 3 and 4 show one preferred embodiment of the present invention. FIG. 3 shows the condition in which cut sheets 19 of A3 size are accommodated in a paper feed mechanism, and FIG. 4 shows the condition in which two stacks of A4-size cut sheets 20 and 21 are accommodated in the paper feed mechanism. Referring first to FIG. 3, two tables 10 and 11, which are provided in a case 6, are moved upward at the same time, by a means for raising and lowering 16, 17, as if they were one table. This movement is the same as in the prior art using one table. Briefly stated, when the cut sheets 19 are supplied, the two tables 10 and 11 automatically move upward by the means for raising and lowering 16, 17 until a height sensor 8 for detecting the height of the stacked cut sheets detects the top of the stacked cut sheets.

When the printing operation is started, the stack of cut sheets 19 are sequentially fed one after another from the top by a pickup roller 5, and are delivered to a printing mechanism (not shown). When the height sensor 8 can not detect the top of the stack of cut sheets 19 as a result of the sequential feeding of the cut sheets 19, the two tables 10 and 11 are automatically moved upward by a predetermined height by the means for raising and lowering 16, 17 so that the top of the stack of cut sheets 19 can be kept substantially at a predetermined height during the printing operation. This movement is repeated until a paper- absence sensor 13 detects the absence of the paper when all the cut sheets 19 are fed out.

As described above, FIG. 4 shows the condition in which the stacks of A 4-size cut sheets 20 and 21 are accommodated.

When the printing operation is started, the stack of cut sheets 20, against which the pickup roller 5 is pressed, are sequentially fed out from its top, and are delivered to the printing mechanism (not shown). When the height sensor 8 can not detect the cut sheets 20, the table 10 is automatically moved upward by a predetermined height by a means for raising and lowering 16 so that the top of the stack of cut sheets 20 can be kept substantially at a predetermined height during the printing operation. This movement is repeated until the paper-absence sensor 13 detects the absence of the paper when all the cut sheets 20 are fed out. During this time, the other table 11 is kept at its lowermost position. When all the cut sheets 20 are fed out, the table 10 descends to its lowermost position to be disposed in side-by-side relation to the other table 11. In this condition, belts 12 are moved by a means for moving 14, 15 in a direction of arrow A to shift the cut sheets 21 from the table 11 to the table 10. When this shifting is finished, the table 10 automatically moves upward by the means for raising and lowering 16, and the same paper feed operation as described above is carried out again.

In the present invention, if N cut sheets of A3 size and B4 size can be accommodated, 2N cut sheets of A4 size and B5 size can be accommodated without increasing the size of the paper feed mechanism. Therefore, a compact and inexpensive paper feed mechanism with a large capacity is provided. Generally, it is rare that A3-size cut sheets are printed in a large quantity, and therefore the amount of accommodation of

What is claimed is:

1. A paper feed mechanism for a printing apparatus comprising:

a case;

a plurality of tables provided in said case for supporting at least two sizes of cut sheets thereon, said two sizes of cut sheets including large-sized cut sheets larger than each of said tables and small-sized cut sheets substantially equal to each of said tables;

means for raising and lowering said plurality of tables in synchrony when said tables support said large-sized cut sheets;

means for raising and lowering said plurality of tables separately and independently of each other when said tables support said small-sized cut sheets;

means for moving said small-sized cut sheets from one of said tables to another of said tables when said another of said tables becomes empty of said small-sized cut sheets.

2. A paper feed mechanism according to claim 1, wherein said plurality of tables comprises two tables.

3. A paper feed mechanism according to claim 2, wherein said large-sized cut sheets comprise cut sheets of A3-size and said small-sized cut sheets comprise cut sheets of A4-size.

4. A paper feed mechanism according to claim 2, wherein said large-sized cut sheets comprise cut sheets of B4-size and said small-sized cut sheets comprise cut sheets of B5-size.

5. A paper feed mechanism according to claim 1, further comprising sensor means for detecting an absence of the cut sheets on said another of said tables; and said moving means for moving cut sheets from said one of said tables to said another of said tables in response to said sensor means.

* * * * *